United States Patent [19]

Kinnebrew, II et al.

[11] Patent Number: 4,886,515

[45] Date of Patent: Dec. 12, 1989

[54] THREAD DYEING APPARATUS AND METHOD

[75] Inventors: Earl Kinnebrew, II; Paul D. Palmer, Sr., both of Edmond, Okla.

[73] Assignee: Rhema Enterprises, Inc., Edmond, Okla.

[21] Appl. No.: 55,413

[22] Filed: May 27, 1987

[51] Int. Cl.[4] ..... D06B 3/04

[52] U.S. Cl. ..... 8/149; 8/151.2; 112/270

[58] Field of Search ..... 68/200, 205 R; 8/151.2, 8/149; 112/270; 101/172; 118/204, 109, 420

[56] References Cited

U.S. PATENT DOCUMENTS

| | | | |
|---|---|---|---|
| 1,953,863 | 4/1934 | Morrell | 68/200 U X |
| 2,310,764 | 2/1943 | Denhof . | |
| 2,325,129 | 7/1943 | Hardy | 68/200 |
| 2,675,755 | 4/1954 | Hall . | |
| 2,800,779 | 7/1957 | Karl . | |
| 2,910,026 | 10/1959 | Ajouelo | 112/270 |
| 3,098,373 | 7/1963 | Langston | 68/200 X |
| 3,098,374 | 7/1963 | Langston | 68/200 X |
| 3,291,097 | 12/1968 | Atkins | 112/270 X |
| 3,948,194 | 4/1976 | Gunold . | |
| 4,015,550 | 4/1977 | Bartenfeld et al. . | |
| 4,254,645 | 3/1981 | Kouris | 68/200 X |
| 4,465,005 | 8/1984 | Eguchi et al. . | |
| 4,538,535 | 9/1985 | Hanyu et al. | 112/270 |

*Primary Examiner*—Frankie L. Stinson

*Attorney, Agent, or Firm*—Dunlap, Codding, Peterson & Lee

[57] ABSTRACT

The present invention comprises a thread dyeing apparatus and method for dyeing a thread. The apparatus comprises a support housing which stores and applies dye to thread moving through a thread opening in the housing. The housing is positioned between the thread source and the end use. In one preferred embodiment, the apparatus is used to dye thread during operation of a sewing machine. The support housing is positioned between the thread spool and the needle of the machine.

2 Claims, 3 Drawing Sheets

THREAD DYEING APPARATUS AND METHOD

FIELD OF THE INVENTION

The present invention relates generally to a dye applying apparatus and method, and more particulary to an apparatus and method for dyeing thread.

SUMMARY OF THE INVENTION

The present invention comprises a dye applying apparatus for dyeing a thread. The apparatus comprises a support housing having a thread opening extending through a portion thereof. The thread opening is sized for receiving a thread so that the thread is movable therethrough. The dye applying apparatus further comprises means positioned in the support housing for storing a supply of dye and for applying dye to the thread as the thread is moved through the thread opening in the support housing.

In accordance with the method of the present invention, the dye applicator is used with a sewing machine having a needle for applying threads received from a thread source. In this method, the dye applicator is characterized by a dye storage portion for storing a supply of dye and an applicator tip which communicates with the dye storage portion. The method comprises the step of contacting the applicator tip with a portion of the thread between the thread source and the needle so that dye is applied to the thread during the operation of the sewing machine.

The present invention also comprises a method for dyeing a thread used in a sewing machine having a needle for applying thread extending from a thread source wherein the dyeing occurs during operation of the machine. The method comprises the step of applying dye to the thread at a position between the thread source and the needle.

The present invention further comprises a method for dyeing thread supplied from a thread source to an end use position. This method comprises the step of engaging a portion of the thread with a dye applicator as the thread is supplied from the thread source and before the thread reaches the end use position. The dye applicator has a storage portion and a dye applying portion, and the thread engages the dye applying portion and is dyed thereby as the thread moves to the end use position.

DETAILED DESCRIPTION OF THE PREFERRED EMBODIMENTS

In the textile and garment industries, there often is a need for frequently changing the color of thread being used. This need arises, for example, in the weaving of multi-colored fabrics and in sewing garments which include different colors of fabrics and in applying contrasting top stitching. For efficient production of such fabrics and garments, large inventories of different colored thread must be maintained. Also, the time required to frequently rethread machines leads to high labor cost, and thus increased product costs.

The present invention greatly reduces the time and labor in changing thread colors. In so doing, the present invention improves the efficiency and decreases the expense of commercial textile and garment manufacturing. The private individual who sews also will appreciate the convenience of fewer thread changes made possible by the present invention.

The present invention comprises a dye applying apparatus for dyeing a thread. It is to be understood that the term "thread" as used herein includes any filamentous material such as ribbon, tape, cord, twine or yarn. Also, the term "thread source" as used herein refers to any item by which thread is stored or dispensed, such as spools, skeins, reels and the like.

Figure 1:
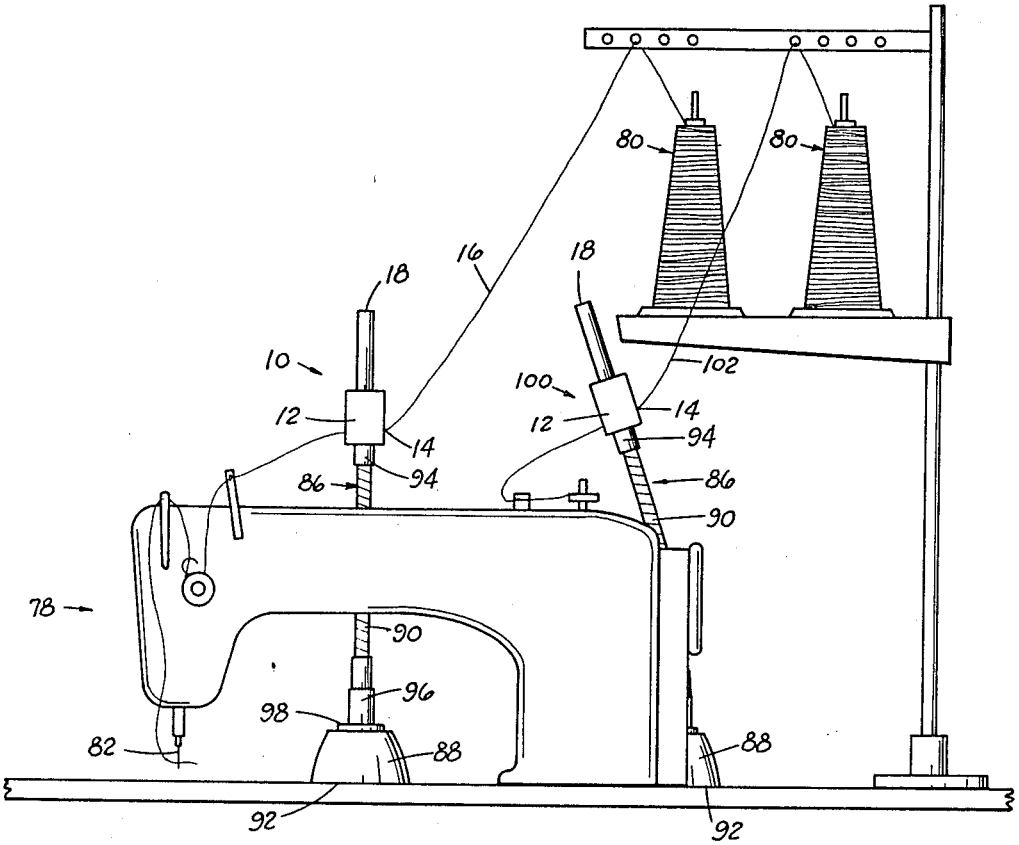
FIG. 1 is an elevational view of a sewing machine assembly comprising the dye applying apparatus of the present invention. In this embodiment, two apparatuses are positioned between the thread spools and the machine so that one apparatus dyes the bobbin thread, and one apparatus dyes the top thread.
Figure 2:
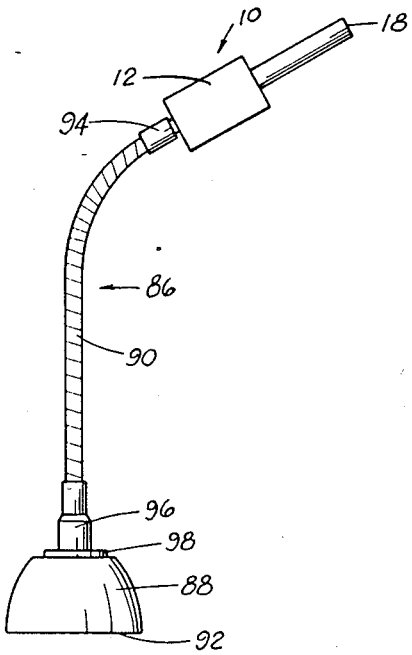
FIG. 2 is an elevational view of one of the apparatuses shown in FIG. 1. A dye applicator is mounted in a support housing which is supported by a stand.
Figure 6:
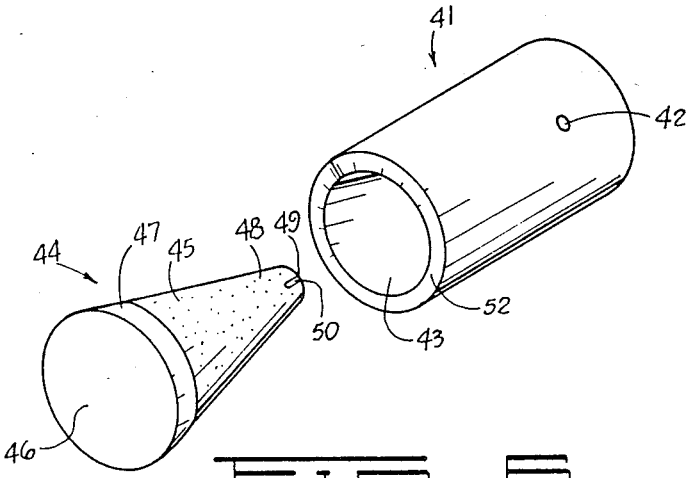
FIG. 6 is a perspective view of another embodiment of the present invention. In this embodiment, the apparatus comprises a dye applicator base with attached protruding cone-shaped dye pad and a support housing adapted to receive the dye pad and base.
Figure 7:
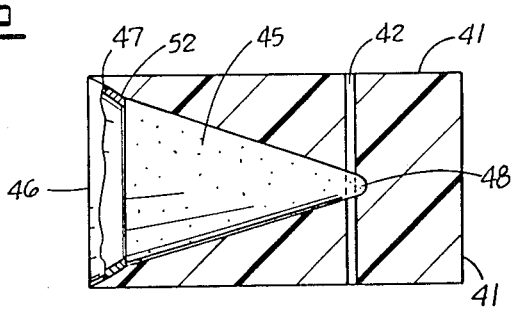
FIG. 7 is a longitudinal cross sectional view of the support housing and dye applicator shown in FIG. 6, and showing the dye pad and base inserted in the housing.

One preferred embodiment of the apparatus is shown in FIGS. 1 and 2 and is designated generally by the reference numeral 10. The apparatus 10 comprises a support housing 12. While the support housing 12 is rectangular in cross section, the support housing of this invention also may take the form of a cylinder or a cube, or any other suitable shapes. For example, the support housing may be cylindrical, as shown in FIGS. 6 and 7 and described hereafter.

Figure 3:
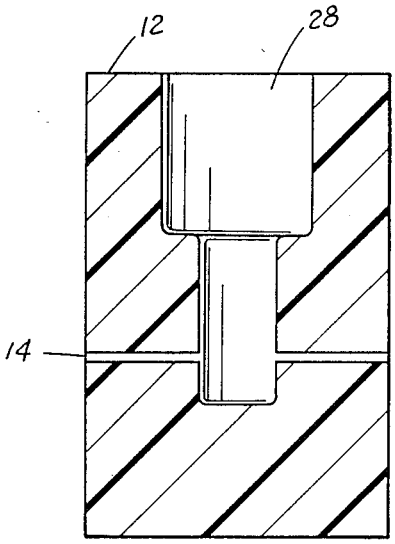
FIG. 3 is a longitudinal cross sectional view of the support housing element shown in FIGS. 1 and 2.
Figure 4:
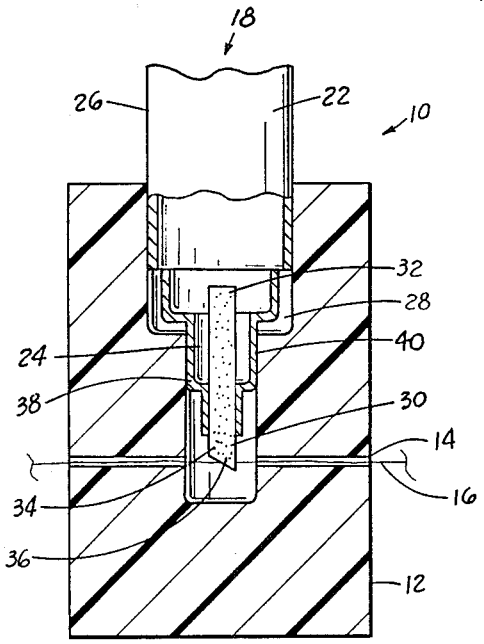
FIG. 4 is a longitudinal cross sectional view of a support housing element having a dye applicator inserted therein, the tip of the applicator being in contact with a thread in the thread opening cavity.

Referring now to FIGS. 3 and 4, the support housing 12 has a thread opening 14 which extends through a portion of the support housing 12. The thread opening 14 is sized for receiving the thread 16 to be dyed so that the thread 16 may move rapidly through the thread opening 14. The thread opening 14 preferably has a diameter larger than the diameter of the thread 16 to provide a clearance therebetween. And, in the preferred embodiment, the thread opening 14 will be only slightly larger than the thread 16 to reduce evaporation of the dye. Also, the surface of the thread opening 14 is preferably smooth throughout its length to facilitate movement of the thread 16 therethrough.

As shown in FIG. 4, a dye applicator 18 may be positioned in the support housing 12 for storing a supply of dye and for applying the dye to the thread 16 as the thread moves through the thread opening 14. The preferred dye applicator 18 has a dye storage portion 22 at one end for storing the supply of dye, and an applicator portion 24 at the other end and which communicates with the dye storage portion. More preferably, the dye applicator 18 preferably comprises an applicator housing 26 having opposite ends. The applicator housing 26 then forms the dye storage portion 22 of the dye applicator 18.

Dye applicators which can be used as the dye applicator 18 are commercially available from such sources as Eberhard-Faber of Wilkes-Barre, Pa. and sold under their mark "MARKETTE", although such dye applicators are not sold for the purposes of the present invention. However, as presently available, such dye applicators generally contain a dye which has a drying time sufficiently long so that the dye on the thread bleeds onto the cloth when used in a sewing machine application for example. Thus, it has been found desirable to substitute the dye in such commercially available dye applicators for a dye having a shorter drying time so the dye will fix to the thread before the thread is applied to the cloth. Commercially available dye applicators of the type mentioned-before also generally are sold with a cap which fits over the end of the dye applicator housing for protecting the tip and reducing loss of the dye through evaporation. This cap is not used in the present invention where the dye applicator 19 fits into and is supported by the support housing 12 and the support housing 12 is constructed to fit over the tip portion for protecting the tip and reducing evaporation loss of the dye, in a manner which will be made more apparent below.

When a dye applicator is used to store and apply the dye, the support housing 12 preferably is provided with an applicator opening 28, as shown in FIGS. 3 and 4, for receiving one end of the dye applicator 18. The applicator opening 28 extends a distance through the support housing 12 so that a portion intersects the thread opening 14. The applicator opening 28 is further adapted for supporting the dye applicator 18 so that when the dye applicator is positioned in the applicator opening, the applicator portion 24 is engagable with a portion of the thread 16 in the thread opening 14. In this way, as the thread 16 is moved through the thread opening 14 in which the dye applicator 18 and the thread 16 are engaged, the engaged portions of the thread 16 are dyed.

With reference to FIG. 4, the dye applicator 18 also preferably includes a tip 30 supported in the applicator housing 26, the tip forming the applicator portion 24. The tip 30 preferably is made of an absorbent material, such as felt, and comprises a dye receiving portion 32 and a dye applying portion 34. The applicator tip 30 is positioned so that the dye receiving portion 32 is in communication with the applicator housing 26 which has the supply of dye. Then, the dye applying portion 34 of the tip 30 is positioned to extend a distance from one end of the applicator housing 26 near the thread opening 14. The dye applying portion 34 preferably is near enough to the thread 16 to engage and thereby dye the thread as the thread 16 moves through the thread opening 14.

Figure 5:
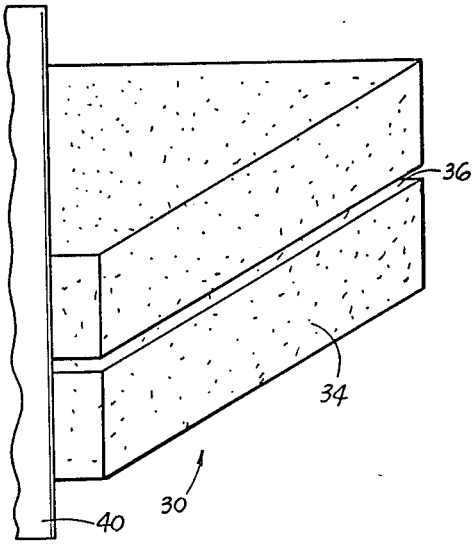
FIG. 5 is a perspective view of a dye applicator tip which is slotted in order to receive a thread.

Referring now to FIG. 5, the dye applying portion 34 of the applicator tip 30 preferably is characterized by a thread slot 36 for engaging the thread 16. The applicator tip 30 then may be aligned in the thread opening 14 so that a thread 16 moving through the thread opening 14 will be engaged in and pass through the thread slot 36. It will be seen that a thread slot 36 serves to maintain engagement of the thread 16 with the tip 30 and ensures more uniform dyeing of the thread.

As indicated above, the applicator tip 30 preferably comprises a felt-like material. However, a tip composed of an absorbent material permits evaporation of dye from the exposed surface. To reduce the rate of evaporation and increase the life of the dye applicator for dye applying purposes, a seal preferably is formed between the dye applicator and the support housing.

To this end, the dye applicator 18 and the support housing 12 may be formed so that a seal is created when the dye applicator 18 is inserted in the applicator opening 28. As best shown in FIG. 4, the applicator housing 26 preferably is characterized by an outer peripheral surface 38, and the applicator opening 28 is formed in a complementary shape. In this way, the applicator housing 26 will sealingly engage the outer peripheral surface 38 of the applicator housing 26 upon insertion therein.

More preferably, the applicator housing 26 is further provided with a protrusion 40 which has an outer peripheral surface 38. This protrusion 40 preferably is formed on the end of the applicator housing 26 from which the applicator tip 30 extends, so that the tip 30 extends from the protrusion 40. Preferably, the applicator opening 28 includes a portion adapted to sealingly engage the outer peripheral surface 38 of the protrusion 40 upon insertion of the applicator housing protrusion 40 into the applicator opening 28.

Another preferred embodiment of a dye applying apparatus of the present invention is shown in FIGS. 6 and 7. In this embodiment, the support housing 41 is cylindrical and the thread opening 42 extends through one end of the cylinder. An applicator opening 43 is formed in the other end. The dye applicator 44 of this embodiment comprises a conical dye storing pad 45, preferably felt, which extends a distance from a disk-shaped applicator base 46. The base 46 has opposite ends, and the edge of the disk defines an outer peripheral surface 47.

With continuing reference to FIGS. 6 and 7, the dye storing pad 45 has a first end connected to the applicator base 46, and a second end opposite the first end which terminates in an applicator tip 48. When formed in this manner, the applicator base 46 with the connected dye storage pad 45 may be inserted into the applicator opening 43 which preferably is formed into a shape complementary to this dye applicator, as best shown in FIG. 7. Thus, when the dye applicator is inserted into the applicator opening 43, the applicator tip 48 is near enough to the thread opening 42 to engage a portion of the thread (not shown) moving through the thread opening 42.

The end of the tip 48 may be formed into a slot 49 sized to receive a portion of thread, as shown in the Figures. Thus, when the dye applicator 44 is inserted into the applicator opening 43, as shown in FIG. 7, the thread moving through the thread opening 42 will be received in the slot 49 and engage the inner surfaces of the tip 50 forming the slot.

To reduce the evaporation of the dye from the surface of the dye storage pad, the applicator and housing are formed to create a seal. For example, with continued reference to FIGS. 6 and 7, the outer peripheral surface 47 of the applicator base 46 may be tapered inward toward the end having the connected dye storing pad 45. Similarly, the applicator opening 43 preferably will be characterized by a complementary tapered portion 52 adapted for receiving and sealingly engaging the tapered outer peripheral surface 47 of the applicator base 46.

Figure 8:
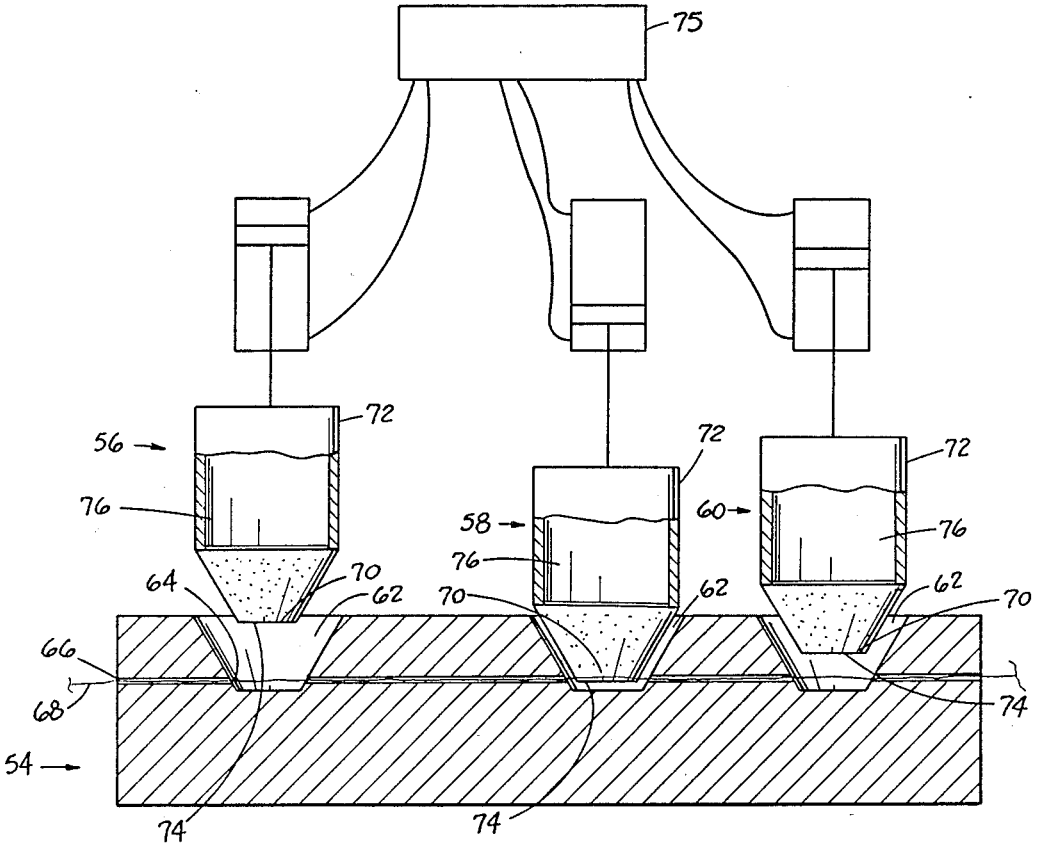
FIG. 8 is a semi-schematic cross sectional view of another embodiment of the present invention wherein the apparatus comprises a plurality of dye applicators supported in a single support housing. A control feature operates to move each dye applicator selectively between a storage position and an engaged position.

Turning now to FIG. 8, the present invention also preferably comprises an apparatus wherein a support housing 54 supports a plurality of dye applicators, designated individually by the numerals 56, 58 and 60. Thus, the support housing 54 is characterized by a plurality of applicator openings, generally designated by the numeral 62, each of which extends a distance through the support housing 54 and has a portion 64 intersecting the thread opening 66. The support housing 54 may be formed into any suitable shape, but it will be appreciated that the applicator openings 62 are best arranged in a linear fashion so that the thread opening 66 forms a straight path for rapid and easy movement of the thread 68.

In the embodiment shown in FIG. 8, the apparatus comprises three dye applicators. However, it will be noted that any number of applicators may be employed. Further, it will be appreciated that the dye applicators utilized in this embodiment may be similar to the dye applicators in the above-described embodiments, and each generally comprises a tip 74 and preferably having a slot 70 and a housing 72. Where the tips 74 are slotted, the slots 70 preferably will be aligned with each other and in the thread opening 66 so that a thread moving through the thread opening 66 will be engagable in each of the thread slots 70.

As shown in FIG. 8, hydraulic cylinders are connected to dye applicators 56, 58 and 60 and controlled by a hydraulic control device 75 for selectively positioning each of the dye applicators 56, 58 and 60, between a storage position and an engaged position. In FIG. 8, the applicators 56 and 60 are shown in the storage position wherein the tip 74 is spaced a distance from the thread opening 66 preventing the dye 76 from being applied to the thread 68. The applicator 58 is shown in the engaged position wherein the thread 68 in the thread opening 66 is engaged with the tip 74 so that dye may be applied thereby. Hydraulic cylinders and controls for such cylinders are well known in the art. It also should be noted that the hydraulic cylinders shown in FIG. 8 could be replaced with solenoid type control devices for selectively positioning the dye applicators 56, 58 and 60.

It will be appreciated that this embodiment is especially useful for fashioning highly complex designs requiring several colors of thread. It will be seen that the number of thread colors provided is not limited to the number of applicators, as more than one dye applicator preferably can engage the thread at the same time to produce a color combination. For example, when a red applicator and a yellow applicator are both engaged, the thread will be dyed an orange color.

The dye applying apparatus of the present invention may be employed to apply dye to a thread being supplied from a thread source to an end use position. For example, as depicted in FIG. 1, the apparatus may be used with a sewing machine 78 wherein the thread 16 is received or fed from a spool 80, threaded through the machine 78 and applied with the needle 82 of the machine. However, as depicted in FIG. 9, other uses may be made of the present invention, which involve thread supplied from a thread source, such as the spool 84, to any of a number of end uses (not shown).

In most applications of the present invention it will be preferred to position the support housing between the thread source and the end use. This positioning is desirable as it provides a straight path for the thread and thereby diminishes resistance caused by passing the thread through the housing.

Figure 9:
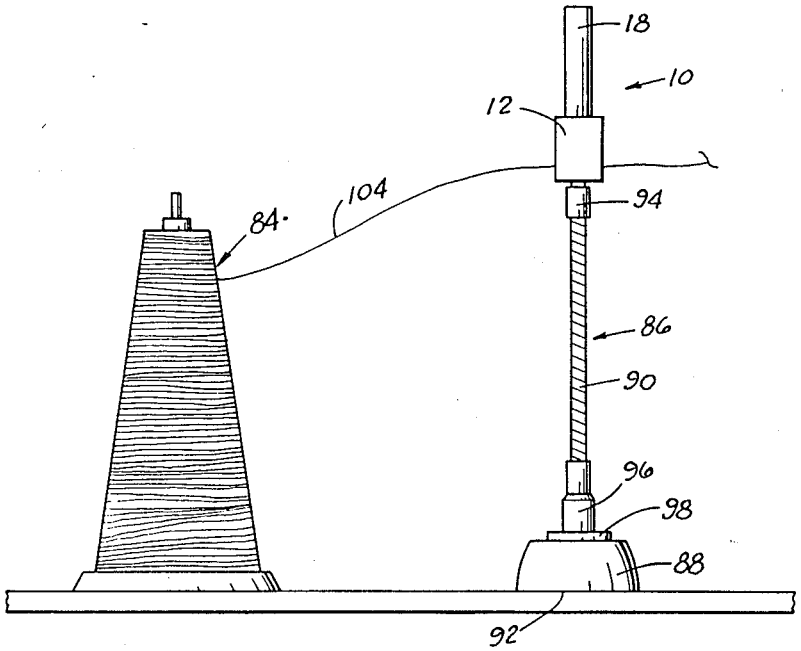
FIG. 9 shows an elevational view of yet another embodiment of the present invention. In this view, thread from a thread source is shown passing through the dye applying apparatus toward an end use position (not shown).

In order to conveniently position the support housing as needed, the support housing may be supported on a stand 86, best shown in FIGS. 1, 2 and 9. Preferably, the stand has opposite ends with one end being connectable to the support housing 12.

More preferably, the stand 86 comprises a base 88 having a neck 90 extending therefrom to which the support housing is connected. The stand base 88 preferably has a broad bottom 92 and is weighed to provide stability for the neck 90 and the support housing 12 supported thereon. The base 88 may be constructed of any suitable material, such as plastic, metal or wood.

The neck 90 preferably is pliable and may be made from a bendable metal commonly referred to as a "gooseneck". Thus, the neck 90 will be selectively positionable for positioning the support housing 12 in preselected positions. The neck preferably has opposite ends, a first end 94 being connectable to the support housing 12, and the second end 96 being connectable to the top 98 of the base 88. It is preferable to provide a threaded connector, or some other removable connecting means, at both ends of the neck 90 so that different support housings and bases may be employed and exchanged as needed.

The above-described stand is a preferred means for positioning the support housing at selected positions. It will be understood, however, that other suitable means may be employed to support the support housing. For example, in some sewing machines (not shown) where the thread spools are mounted on the top of the machine, it may be suitable to attach the support housing directly to the top of the machine. A commercially available self-gripping fastener, such as "Velcro", may be conveniently employed in this instance.

In accordance with the method of the present invention, thread may be dyed as it is supplied from a thread source and before it reaches an end use position, as generally depicted in FIG. 9. For example, as shown in FIG. 1, thread used in the sewing machine 78 may be dyed during the ordinary operation of the machine by applying the dye to thread 16 at a position between the thread source (spool) 80 and the needle 82. As shown, this method may be carried out by positioning a dye applicator 18 near the thread 16 so that the thread is dyed as it moves therethrough. As shown in FIG. 1, in many instances it will be desirable to include a second dye apparatus 100 for dyeing the bobbin thread 102 the same or a different color as the top thread 16.

It will be appreciated that in accordance with the methods of the present invention, the dye applicators in the support housings can be removed at any time and replaced with dye applicators having dyes of different colors. It also now will be understood that in practicing the present invention, it will be preferred to use a dye which has a drying time sufficiently short so that the dye will fix on the thread before the thread reaches the needle or other end use position.

From the foregoing, it will be appreciated that the present invention provides thread users with a valuable alternative to changing thread each time a different color of thread is needed. The present invention is particularly suited for use during the ordinary operation of a sewing machine and is easily adapted for commercial and consumer models alike.

Changes may be made in the construction, operation and arrangement of the various parts, elements, steps and procedures described herein without departing from the spirit and scope of the invention as defined in the following claims.

What is claimed is:

1. A method for dyeing a thread used in a sewing machine having a needle for applying the thread extending from a thread source wherein the sewing machine includes a bobbin thread, a bobbin thread source and a bobbin for receiving the bobbin thread, and wherein the dyeing occurs in the operation of the sewing machine, the method comprising the steps of:

applying dye to the thread at a position between the thread source and the needle comprising:

engaging portions of the thread with a dye applicator having a dye storage portion for storing a supply of dye and a dye applying portion in communication with the dye storage portion and adapted to engage the thread for applying dye thereto, and wherein the thread engages the dye applying portion as the thread moves from the thread source to the needle; and positioning a second dye applicator near a portion of the bobbin thread, wherein the second dye applicator has a dye storage portion for storing dye and a dye applying portion in communication with the dye storage portion and adapted for engaging the bobbin thread for applying dye thereto; and engaging portions of the bobbin thread with the dye applying portion of the second dye applicator as the bobbin thread moves from the bobbin thread source to the bobbin.

2. The method of claim 1 wherein the dye is characterized by having a drying time sufficiently short so the dye dries on the thread before the thread reaches the needle.

* * * * *